US007024772B1

(12) United States Patent
Shaver et al.

(10) Patent No.: US 7,024,772 B1
(45) Date of Patent: Apr. 11, 2006

(54) CASE KNIFE WITH MULTIPLE POSITION BLADE GUARDS

(75) Inventors: Billy J. Shaver, Denver, CO (US); Randy R. Busby, Lakewood, CO (US); James S. Carter, Denver, CO (US)

(73) Assignee: Specmaster Inc., Denver, CO (US)

( * ) Notice: Subject to any disclaimer, the term of this patent is extended or adjusted under 35 U.S.C. 154(b) by 0 days.

(21) Appl. No.: 10/301,408

(22) Filed: Nov. 21, 2002

Related U.S. Application Data

(60) Provisional application No. 60/332,656, filed on Nov. 21, 2001.

(51) Int. Cl.
*B26B 3/08* (2006.01)

(52) U.S. Cl. ..... 30/2; 30/286

(58) Field of Classification Search ..... 30/2, 30/162, 286, 293, 294
See application file for complete search history.

(56) References Cited

U.S. PATENT DOCUMENTS 2,376,887 A * 5/1945 Walters ..... 30/125
2,743,523 A * 5/1956 Honey ..... 30/286
3,781,988 A * 1/1974 Jones ..... 30/2
4,675,996 A * 6/1987 DuBuque ..... 30/2
4,980,977 A * 1/1991 Matin et al. ..... 30/286
5,241,750 A * 9/1993 Chomiak ..... 30/2
6,178,640 B1 * 1/2001 Votolato ..... 30/2
6,233,832 B1 * 5/2001 Berns ..... 30/162
6,560,873 B1 * 5/2003 Ortner et al. ..... 30/2
6,578,266 B1 * 6/2003 Chomiak ..... 30/2
6,637,112 B1 * 10/2003 Davis ..... 30/2

* cited by examiner

*Primary Examiner*—Hwei-Siu Payer
(74) *Attorney, Agent, or Firm*—Gregory W. O'Connor

(57) ABSTRACT

A case knife (1, 101), generally consists of a pair of substantially symmetrical handle shells (13, 112). A single edge razor blade B is removably supported in one end of the handle formed by these handle shells. Each handle shell includes two moving parts—a guard (10, 110) and a thumb or finger operable button (5, 105). Each such guard, when paired with a substantially identical guard of the other handle half shell, flanks the otherwise protruding sharp edge of the razor blade. Each guard can move independently to expose a protruding corner of the razor blade. The operable button is mounted on an axle or lug (14, 103) that passes from the inside of a handle shell, through to its outside surface. This axle is in turn fixed to a cam follower (20, 120) mounted on the inside of each shell.

8 Claims, 9 Drawing Sheets

CASE KNIFE WITH MULTIPLE POSITION BLADE GUARDS

CROSS REFERENCE TO RELATED APPLICATIONS

This application is related to Provisional Patent Application Ser. No. 60/332,656 filed Nov. 21, 2001, and claims benefit of this provisional application's filing date. This application is also related to Design Patent Application Serial No. 29/150,554, which was also filed on Nov. 21, 2001.

BACKGROUND OF THE INVENTION

This invention deals generally with so-called case knives, that is knives specifically designed to cut open corrugated cardboard packing cases or cartons. A problem with prior case knives is that it is very difficult to control the depth to which the blade, (usually a replaceable and disposable steel blade such as a single-edge razor blade), penetrates through the corrugated cardboard panel or edge of a case. Inadequate penetration can result in inefficiencies. For example, the lid or panel of the corrugated cardboard case will not fully separate from the base. Perhaps more importantly a case knife blade, if it penetrates too deeply into the corrugated cardboard panel, can damage the packing case contents. If the contents are foodstuffs, such too deep penetrations can result in spoilage or consumer rejection of the products, as for example when the case knife blade has opened the individual packages of food, such as breakfast cereals and the like. Another problem with prior case knives is the risk that the operator can be cut with the exposed edge or pointed end of the case knife blade. While some prior knives include spring-operated guards and the like, such guards tend to be cumbersome and even when operating properly, can still present an unduly high risk of injury to the operator.

U.S. Pat. No. 5,241,750 shows a case knife with a fixed blade 13 and a movable hood 12, which can be locked in a position that resists displacement away from the blade by arc 60. This hood consists of a generally U-shaped member. There are other such fixed blade case knives, such as U.S. Pat. Nos. 2,730,800, 4,744,146 and 6,233,832. In each disclosed device, the guard can be placed in a position to shield the knife blade. Other prior case knives include mechanisms for automatically withdrawing the blade into the handle of the case knife to prevent injury. Examples of these are U.S. Pat. Nos. 4,139,939, 4,713,885 and 3,641,667. One characteristic of these movable blade knives is a fairly complex blade positioning mechanism, which can result in higher manufacturing costs, poor operability, and difficulty in properly positioning the blade when the blade needs to be replaced.

Another problem with prior case knives is that they favor a right or left-handed operator. One prior case knife construction shown in U.S. Pat. No. 5,012,581 attempts to solve this problem by providing a case knife handle construction that accommodates a triangular blade in one of the two positions, so that the blade protrudes in a preferred position for either a right or a left handed operator. This system, however, requires the user to elect whether the case knife will be configured for use in the right or left hand when installing the blade. Once the blade is installed, the case knife cannot necessarily be easily operated with the opposite hand until the blade is re positioned in the handle.

Some prior case knives include a guard used to position the case knife at a proper distance along a right-angled edge or corner of a corrugated cardboard box. The purpose and intention of this guard is to assure that the blade of the knife penetrates the box at the ideal position along the edge of the box, while holding the blade to just sever a lid or panel of the box without penetrating the contents. One such prior case knife is shown in U.S. Pat. No. 2,376,887. Here, means 59 provides a guide for the blade along the edge or surface of a corrugated box.

OBJECTS OF THE INVENTION

Accordingly, it is an object of the subject inventive case knife to provide a case knife construction that provides separately operable guards, each one on each side of a replaceable blade to thus flank the blade. The blade is held in a fixed position within the handle shell and positioned between each of the two separately operable guards. Thus, each guard can be operated independent of the other, to permit the operator to expose one or the other sides of the blade, or to displace both of the guards away from the blade's sharp edge to permit the blade to protrude from the case knife structure and result in superior operation.

It is another object of the inventive case knife to present a case knife structure that can be operated with either hand, while simultaneously providing an automatic or spring operated guard to help make the case knife safer to operate.

It is also an object of the disclosed case knife to provide a system for guarding the protruding blade edge of the case knife, which can be selectively moved by proper application of the case knife to the edge of a corrugated cardboard box and the like, which edge displaces one guard an adequate distance while the other guard remains in position to guide the knife at an appropriate distance along the edge of the corrugated packing case.

It is another object of the invention to provide a case knife with a pair of separately operable guards which closely flank the cutting edge of the knife blade, each of the guards being operated by a button which is moved by the users thumb or finger, the button having several positions, each placing the guard in a different condition. Among the conditions are a fully locked condition in which the guard resists exposing the knife blade, a first unlocked condition in which the guard permits the blade to project beyond the guard to a first cutting depth, and a second unlocked condition in which the guard permits the blade to project beyond the guard a second cutting depth.

It is another object of the invention to provide a case knife with a pair of relatively movable guards closely flanking the knife blade at one end of the case knife, the guards having operating means which project out of a side of the knife handle for placing the one or both of the pair of guards in a locked condition and an unlocked condition, and a sheath sized to receive at least the end of the case knife having the blade, the sheath having an interior surface for engaging the operating means, whereby when the case knife is inserted in the sheath the operating means is operated by the interior surface of the sheath to place the guards in a locked condition.

DETAILED DESCRIPTION OF THE INVENTION

Figure 1:
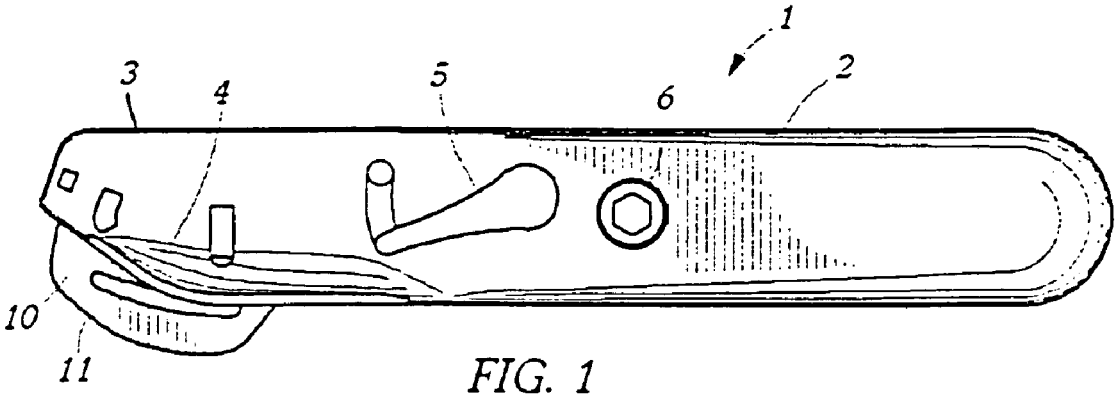
FIG. 1 shows a side view of a case knife according to the instant invention.
Figure 2:
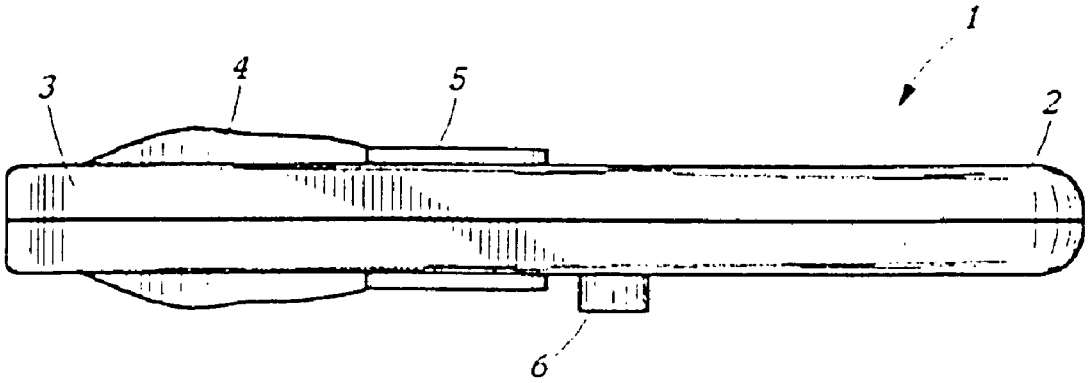
FIG. 2 shows a top view of the case knife depicted in FIG. 1.
Figure 3:
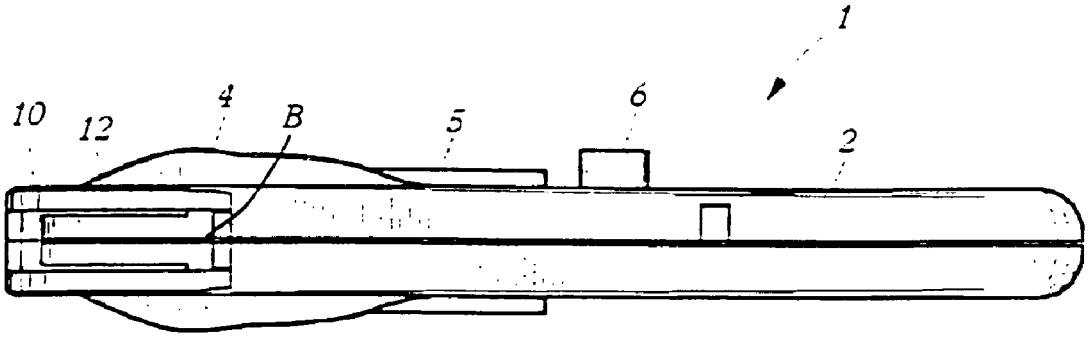
FIG. 3 is a partial bottom view of the inventive case knife.

The case knife 1 has a generally elongated, prismatic shape, typical of the conventional case knives used in the grocery or supermarket industry. There is a grip portion 2 towards one end and a blade-containing portion 3 at the opposite end. Along one lower edge of each side of the blade containing end or portion 3 protrude a pair of thumb rests 4, consisting of a pair of protruding flanges, generally symmetrically identical. These are integrally molded to protrude on each of the two shells halves making up the case knife shell. On each case knife shell half there is a generally elongated, thumb-operated button or lever 5, which pivots around its axle 14 and has at least two operative positions, as will be detailed.

A conventional knurled bolt 6 engages embedded nut 7 to hold the two shell halves together during use and to clamp and hold the blade B between the two shell halves. Each shell half includes protrusions 19 which also engage and hold the blade firmly and in the correct position when the halves are assembled to form the handle.

Figure 4:
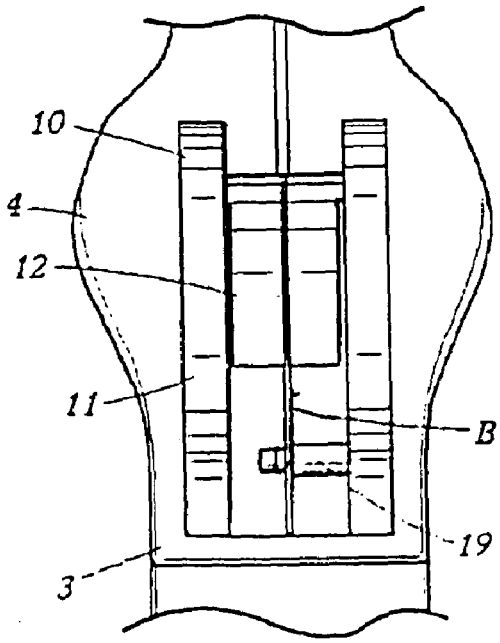
FIG. 4 is an end view of the inventive case knife.

A pair of separately operable guards 10 protrudes from the blade-containing end of the handle shells. Each guard 10 consists of a protruding flange 11 shaped to normally project beyond the edge of a properly installed single-edge razor blade contained within the shell halves. Each guard also consists of a supplemental guard finger or supplemental guard 12 carried by the adjacent guard 10 and positioned inwardly from the guard edge 11 and towards the blade. Each of these supplemental guards 12 is positioned immediately adjacent the blade edge on either side thereof (refer to FIGS. 4 and 6.) Each of the supplemental guards 12 is integrally molded with the rest of the guard 10. The guards 12 are preferably made of a tough, resilient polymer material, such as Delrin brand of Acetal thermoplastic molding composition.

In greater detail, each guard is affixed to the inside of each shell half by rivet-like pivot 15. In addition to the flexible supplemental guard 12 there is included a cam surface 16 affixed to the guard for rotation therewith about pivot 15. A small resilient spring portion 17 is held in position by a small stud or protrusion 18, (see FIG. 8) integrally formed on the inside of each shell. The main guard edge 11, the flexible supplemental guard 12, cam surface 16 and leaf spring 17 are preferably integrally molded of a tough, resilient and friction resistant plastic such as acetyl nylon or polycarbonate. As will be detailed, the spring portion 17 normally holds the guard in a protruding position to shield the projecting edge of the razor blade edge.

Figure 5A:
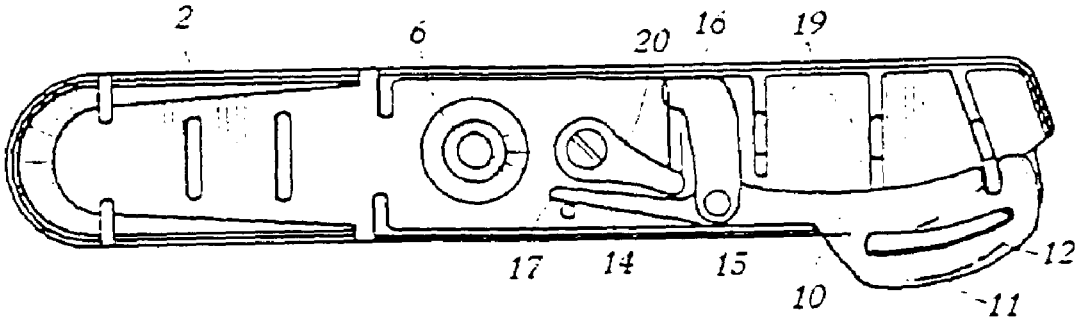
FIGS. 5*a* and 5*b* are respectively plan views of the inside of the a first shell half and a second shell half which assemble to make the handle of the case knife.
Figure 5B:
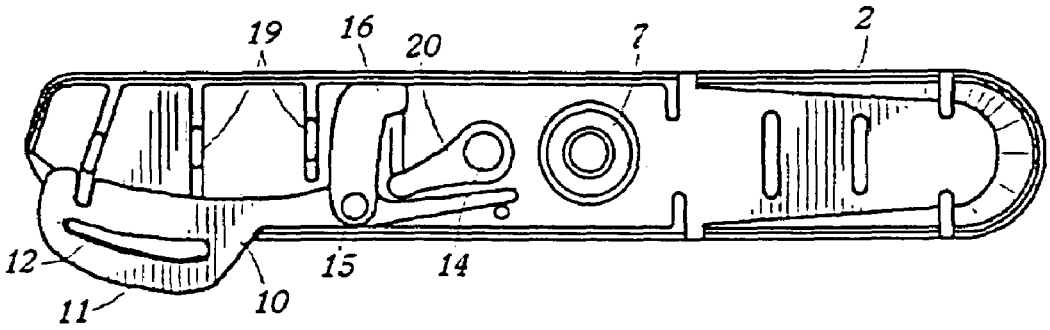
Figure 6:
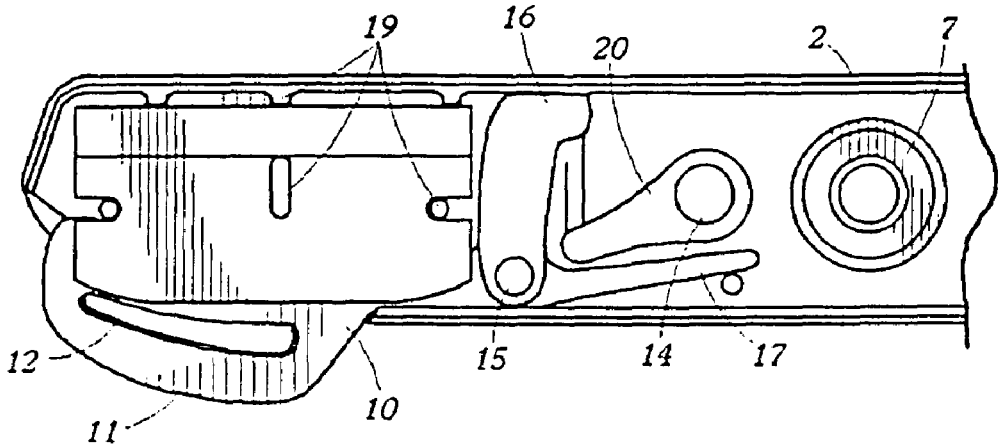
FIG. 6 is a close-up of one end of the handle shell half shown in FIG. 5*b*, with a single-edge razor blade installed and the operator positioned to place the guard in the unlocked position.
Figure 7:
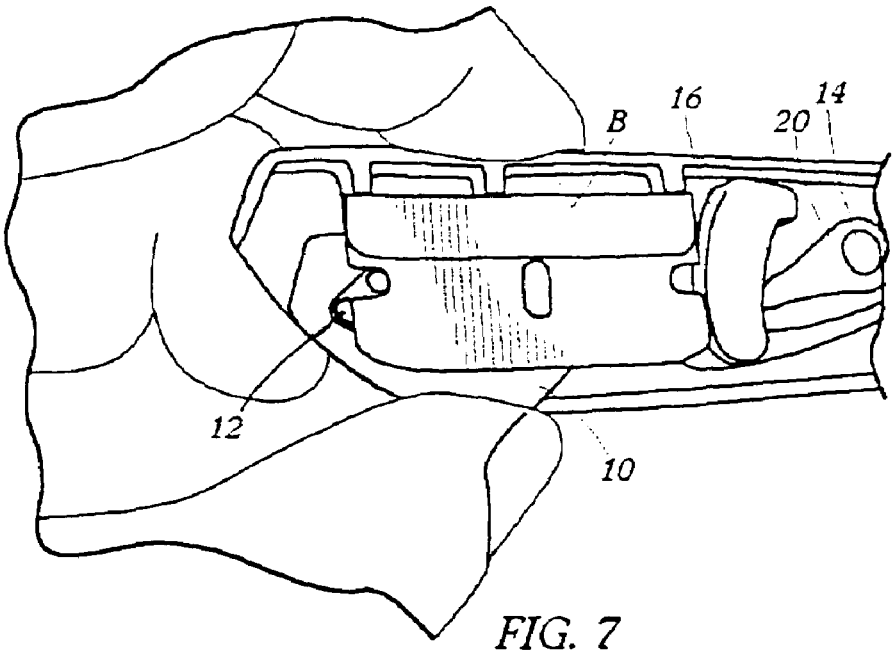
FIG. 7 is similar to FIG. 6 showing the guard, deflected by the application of pressure to the guard in an unlocked condition that permits the blade to contact a surface to be cut.

Each thumb-operated lever 5 is connected to a shaft that penetrates through the wall of each handle shell and is affixed to a guard actuator, here shown as a cam follower arm 20. The cam follower arm 20 is mounted on the inside of each shell and is positioned to block or to permit the motion of the guard 10 by respectively engaging or not its protruding cam surface 16. As seen in FIGS. 5*a* and 5*b*, each cam follower arm 20 has been moved into position by operating the thumb lever 5 so as to not block the motion of each corresponding guard 10. Referring to FIG. 6, the blade B is installed to show the position of its protruding corner relative to the guard 10 and supplemental guard 12. Only the spring member 17 holds these guards in this guarding position. The spring biasing force provided by member 17 can be overcome by pressing the guard against the carton panel. The cam follower 20 will not interfere with the retraction of the guards in response to being pressed against the carton face.

Figure 8:
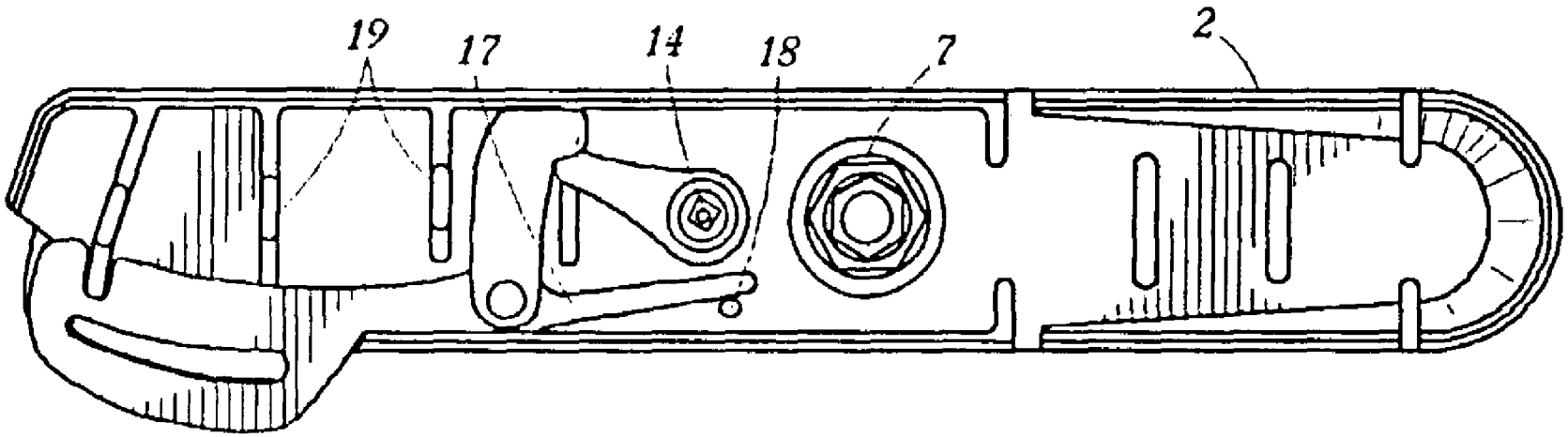
FIG. 8 is the case knife shell shown in FIG. 5*b* with the guard in the locked position and guard and other movable parts in phantom lines.
Figure 9:
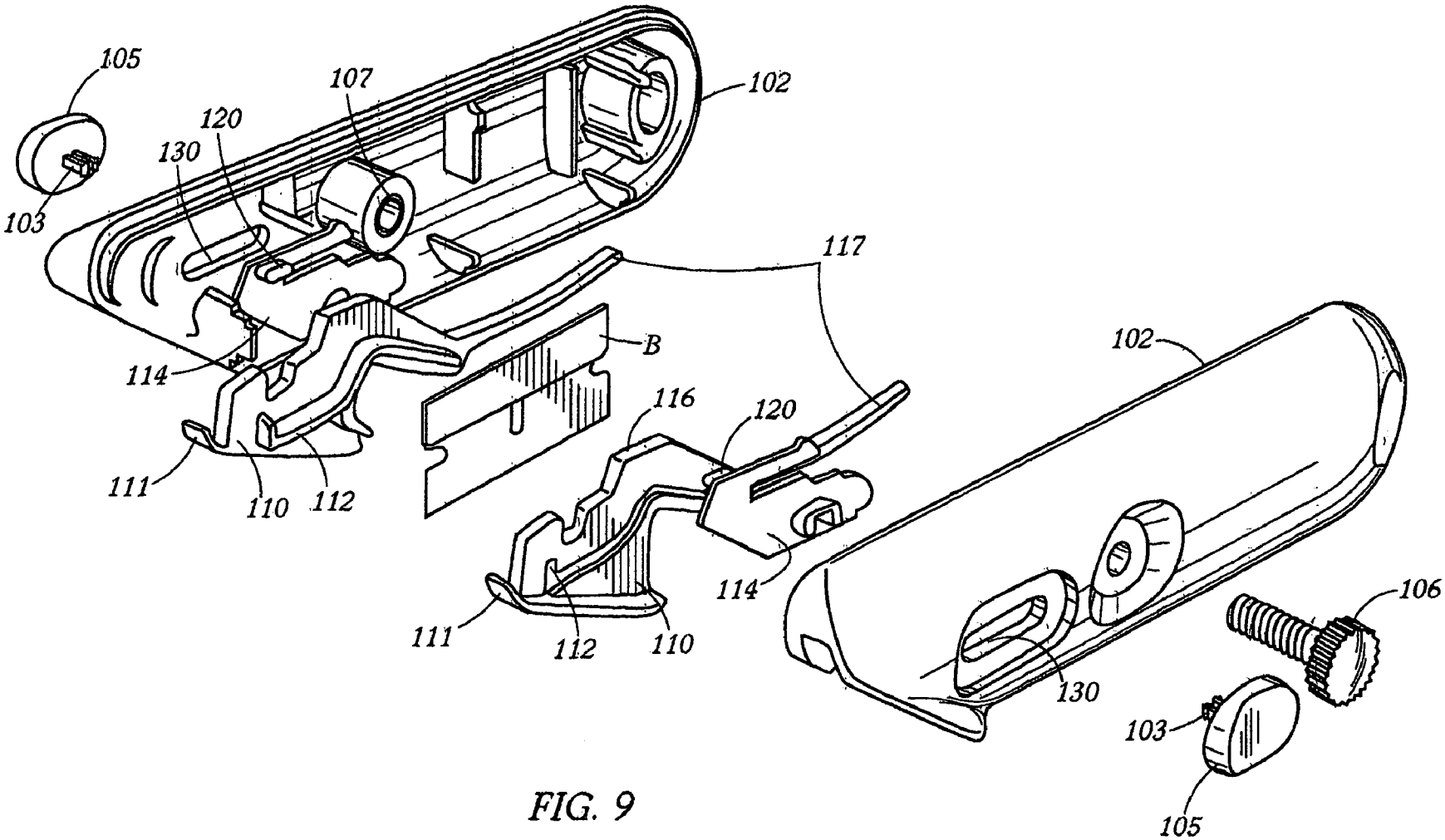
FIG. 9 is an exploded view of another embodiment of the inventive case knife, showing a sliding type of thumb-operated actuator button or operator.

In FIG. 8, however, as seen in greater detail, the cam follower arm 20 engages cam surface 16 at a position remote from axel 15, thus blocking any retracting motion of the guard 10. Thus, it can be seen that depending on the position of one or both of the thumb operated levers 5 the guards 10 flanking the blade will either permit the blade to operably engage a surface to be cut, such as corrugated cardboard carton panel, or to not engage that surface.

As mentioned above, the guards 10 have a second function, that is to guide the blade in a precise manner along a corner edge of the cardboard carton so that an adjacent cardboard panel can be severed from the box at that corner edge. This operation will now be explained In order to cut along the edge of cardboard box, one of the thumb-operated levers is placed in a first operating position, in particular, down towards the thumb rest 4. This moves the cam follower arm 20 away from cam surface 16 and towards the axle 15 and thus permits the guard to deflect upwardly to expose the blade when the guard is rotated toward the handle by being pressed against the surface being cut. The other thumb-operating lever is placed in a position away from the thumb guard, thus placing the cam follower in contact with the cam 16 away from axle 15, (FIG. 8), and thus blocking the rotation of the guard. In these positions, the unblocked guard is placed against the side of the carton to be cut, while the blocked guard is placed to rest upon the corrugated cardboard panel at right angles to the panel to be cut. The operator now merely presses the blade into the cardboard panel. This deflects the guard in the released position and the blade penetrates the corrugated cardboard panel. The fixed guard acts as a guide, sliding along the cardboard panel at right angles to the one being cut. Thus the operator helps hold the case knife along the corner edge during the cutting or slicing operation.

Should the operator wish to cut using the other hand, or perhaps cut a panel with the blade on the other side of the cut, the operator needs only to shift the position of each of the thumb operated levers—that is the lever that was in the down position is now moved to the up position and the lever in the up position is moved to the down position. This releases the opposite guard to permit that guard to deflect inwardly when pressed against the carton panel and locks the other guard from deflecting. The user now merely places the fixed guard against the edge to be cut and presses the blade into the adjacent cardboard panel, deflecting the released guard to expose the blade. The blade penetrates the cardboard panel, and is guided along the edge corner of the cardboard container to complete the cut. The distance between the inner surface of each guard edge 11 and the blade being guarded has been fixed to approximately the thickness of a typical corrugated cardboard packing case panel. Thus whichever guard 10 serving as a guide in this operation places the blade, and thus the cut made by a properly operated case knife, just to the inside of the corrugated cardboard panel to be removed.

An important and extra safety feature of the inventive case knife is the flexible supplemental guards 12 located interiorly of each main guard edge 11. These, as mentioned before, immediately flank the protruding blade and can in fact rest on each side surface of the blade near the cutting edge thereof. The main function of these supplementary guards is to prevent the fleshy part of the finger or palm from protruding in between the inner sides of guard edges 11 on each guard 10 and advertently come in contact with the protruding blade edge. Thus, the safety function of the guards is less likely to be compromised because of the spacing required to permit the guards to operate as guides for cutting along the corner edges of corrugated cartons, as outlined above. This is so because the flexible fingers are spaced close enough to the blade and are stiff enough to resist direct, inadvertent contact in all but the most vigorous and harsh pressing of the fleshy portion of a palm or finger between the guards 10 when they are in the locked condition. Yet each of these supplemental guard fingers 12 can deflect out of the way when the knife is properly operated with one of the guards in the unlocked condition. For example, the supplementary guard on a locked guard will flex along with the unlocked guard on the opposite side of the blade, moving out of the way to allow the blade to make a cut to the proper depth.

Referring to FIGS. 9 through 14, a second preferred embodiment 101 of the inventive case knife is shown. Here, corresponding parts function similarly to those discussed above, however, this embodiment provides some additional functions and advantages that will now be detailed.

Note in these figures, each of the actuating buttons 105 slides along a slot 130 provided in the corresponding handle shell 102. Each button 105 has an integrally molded lug 103 that has resilient detents that affix the button to a correspondingly square-shaped hole in the body of the actuator 114. The actuator slides along a linear path defined by the slot 130 next to its corresponding guard 110. The actuator has a protrusion or cam follower 120 in the form of a stud that protrudes from the side of the actuator facing the guard. This protrusion acts much like the cam follower 20 of the previous embodiment in that it blocks or permits motion of the guard depending on its position along a complex cam surface 116 extending along the upper face of each guard 110. The cam surface 116 has three stepped portions that can be engaged by the protrusion 120. When the stop is in the rearmost position (to the right as viewed in FIG. 9, for example), relative motion of the guard 110 is essentially prevented. This is the locked condition for that respective guard (see FIG. 11).

Figure 10:
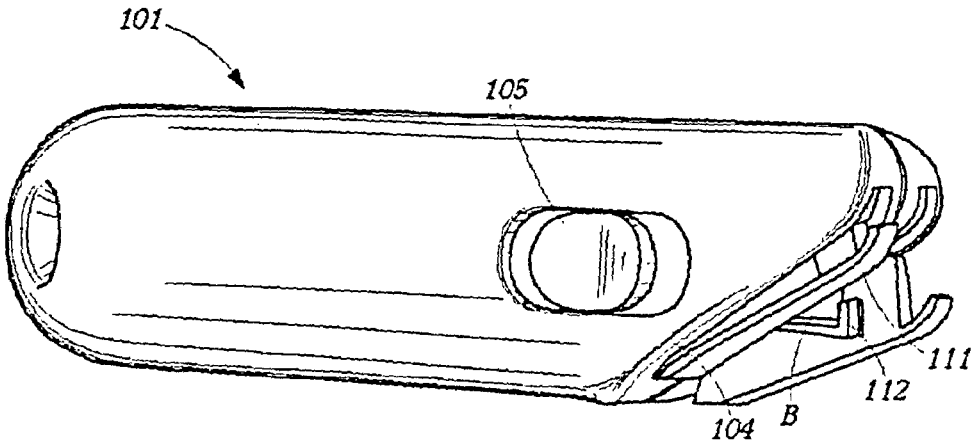
FIG. 10 is a perspective view of the case knife of FIG. 9 with the actuator button in the first or unlocking position and the corresponding blade guard deflected to expose the blade corner.
Figure 11:
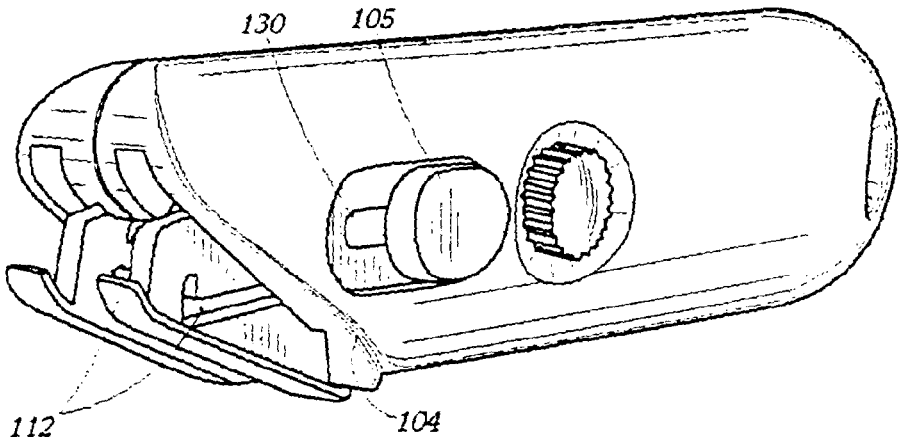
FIG. 11 is another perspective view showing the opposite side of the case knife shown in FIG. 10, but with the operator button in the fully locked position and the corresponding guard in the fully extended or deployed position.
Figure 12:
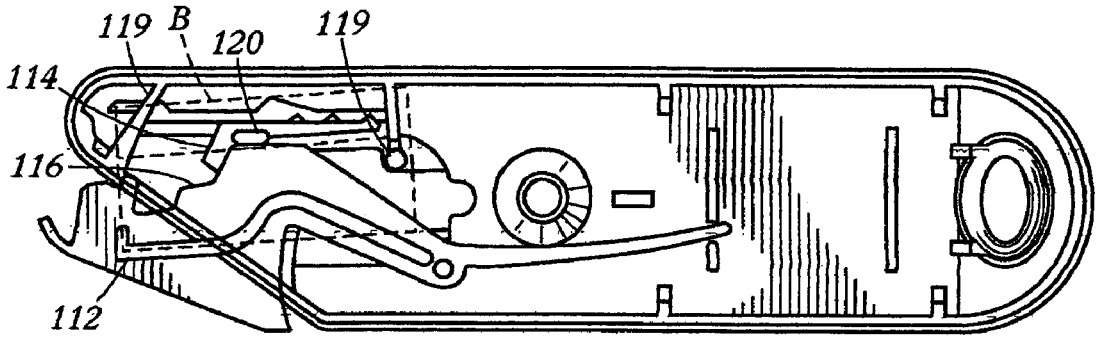
FIG. 12 is plan view of the inside of the case knife showing the operator holding the blade guard in the full locked position.

In the first unlocking position of the actuator, the stop is positioned to engage the middle step at the central portion of the cam surface 116. In this condition, the guard is permitted to deflect against the bias of the spring arm when the operator presses the guard against the box surface to be cut. The guard deflects the ideal distance, preferably about 0.125", to just permit the corner of the blade B held in between the handle shell half 102 by protrusion 119, etc (FIG. 12) to penetrate a single thickness of corrugated cardboard. FIG. 10 shows an actuator button and its associated guard in this condition.

Figure 13:
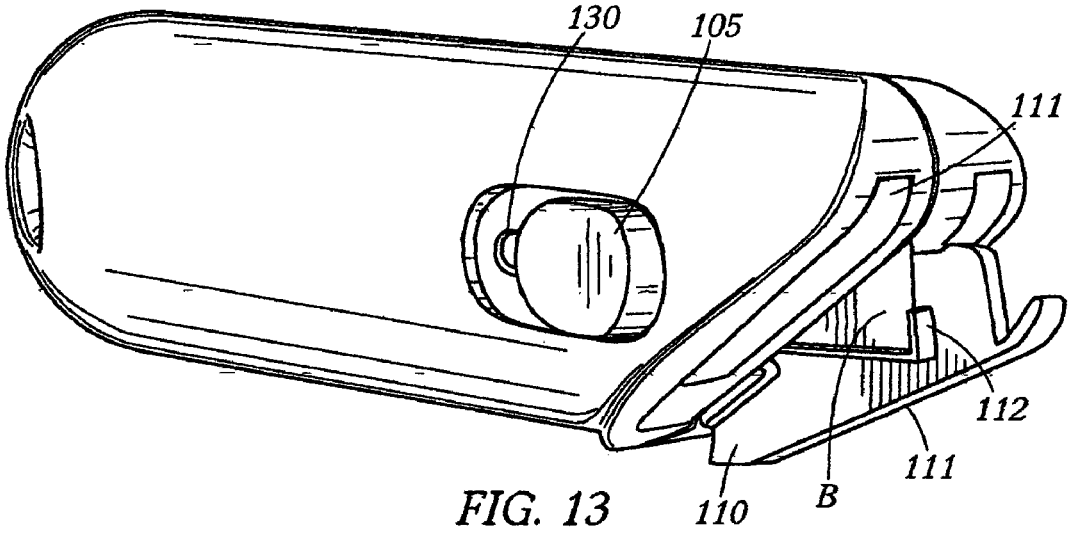
FIG. 13 is a perspective view of the case knife showing the nearest guard and its supplemental guard pushed flush into the handle housing.
Figure 14:
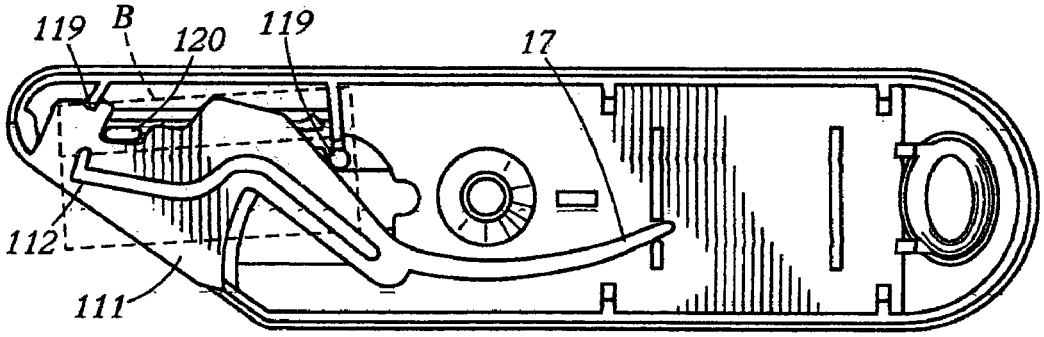
FIG. 14 is a plan view of the interior of the case knife of FIG. 13.

When the button, and thus the operator, is moved to its position fully forward, (or to the left as in FIG. 9,) the guard is thus placed in a fully unlocked condition. This permits the blade to protrude beyond the guard a full 0.250", thus permitting the blade to cut through two thicknesses of corrugated cardboard. The various mechanisms are shown in FIGS. 13 and 14 in this fully unlocked, or so called deep cutting position.

Thus it can be seen that there is a logical correlation between the positions of the actuator buttons and the functioning condition of the guard associated with that actuator button. That is, when the button is pulled back, the blade is essentially "back" or in a withdrawn position within the guard. When the actuator button is moved forward, the blade moves, at least relative to that guard "forward", to permit the blade edge to engage and cut the intended cardboard panel preferably to one or two depths.

Figure 16:
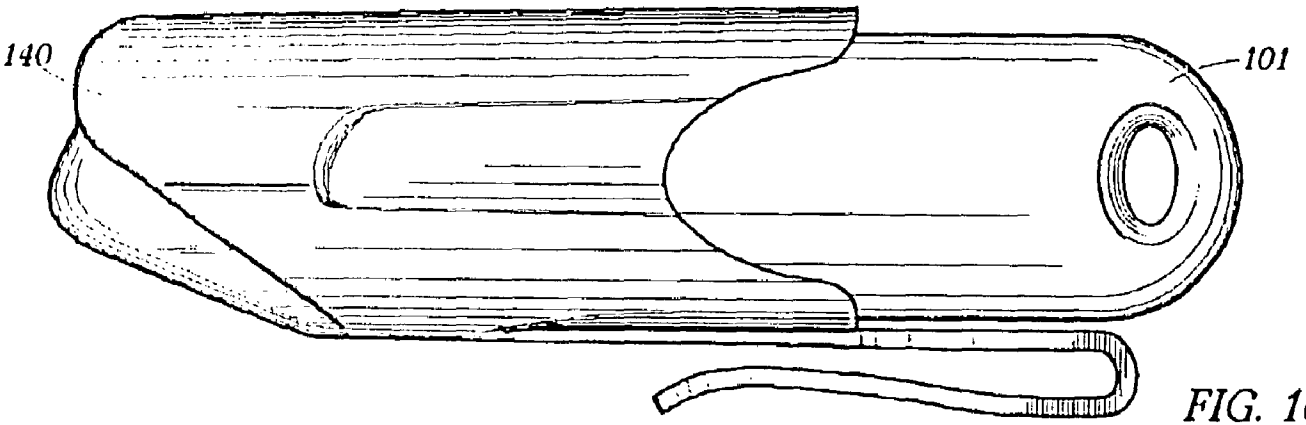
FIGS. 15 and 16 are a perspective view and a plan view of the case knife installed in a specially shaped storage sheath.
Figure 15:
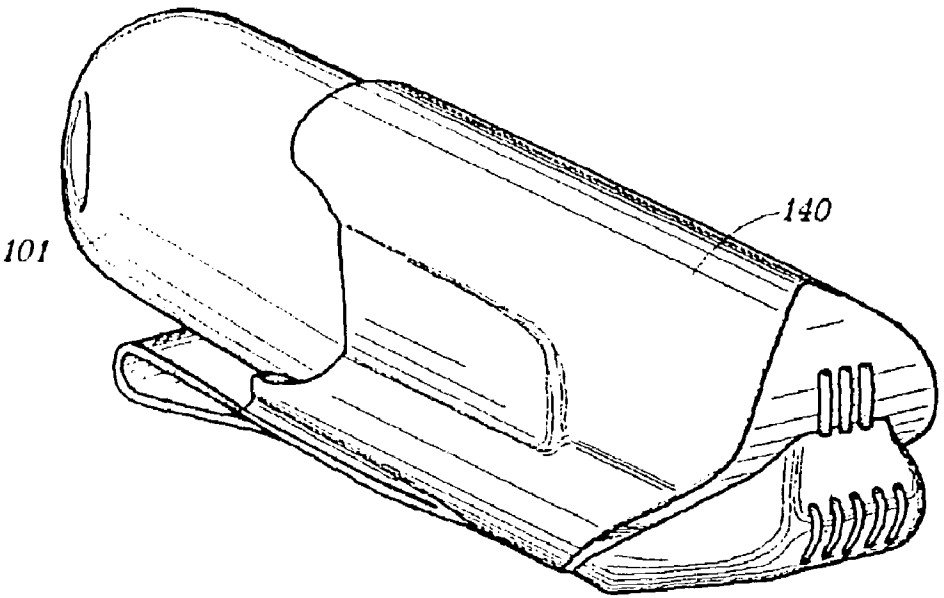
Figure 17:
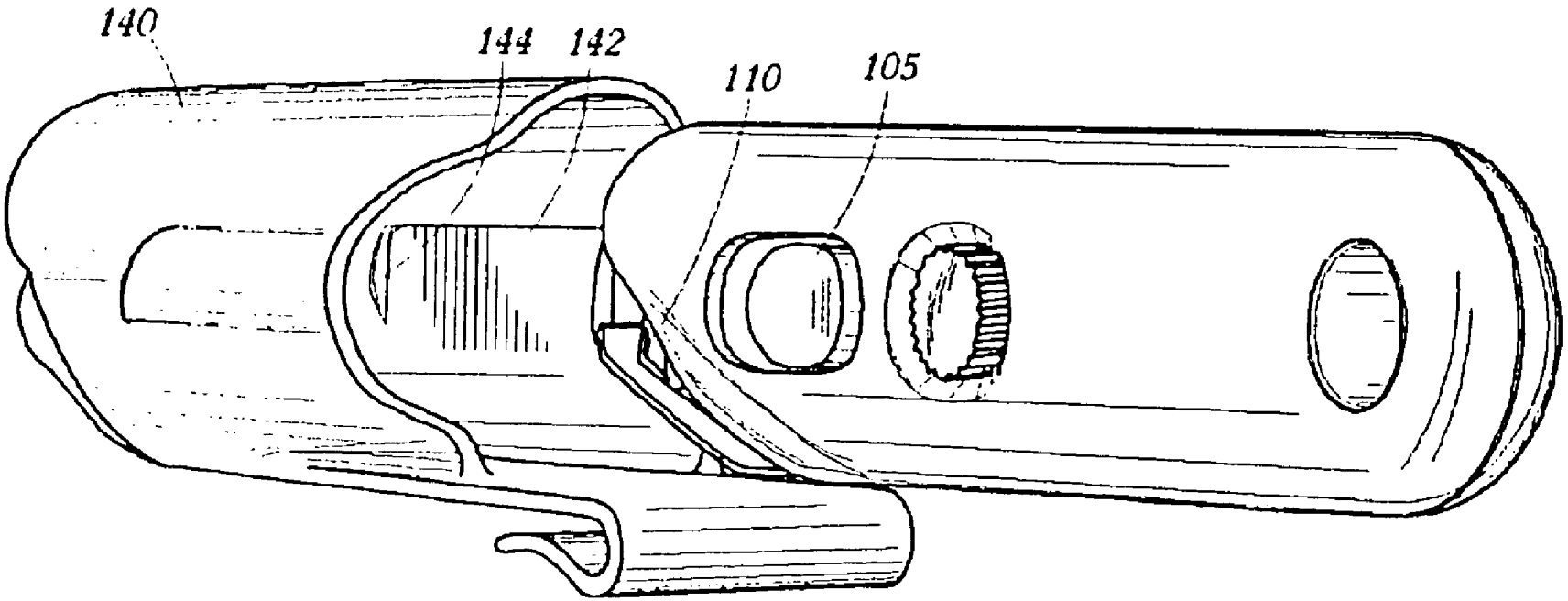
FIG. 17 shows the interior of the sheath with a special feature to engage and operate the actuator button.

The actuator buttons protrude from the profile of the handle shells on both sides. This not only permits easy operation by the digit of the operator, preferably the operators thumb, but also permits the specially formed holster or sheath 140 shown in FIGS. 15 through 17 to not only hold the inventive knife when not in use, but also engage and move the operator buttons to their "back" or locking position when the knife is shoved into the sheath. Note the sheath has a symmetry similar to the knife itself This symmetrical shape includes slightly protruding slots 142 along the sides that extend from the sheath opening to part way down the sides toward the closed bottom end. These slots thus define a bottom edge 144 of the slot, which engages the leading edge of the corresponding actuator button received in the slot. The depth of these slots, and thus the location of this bottom edge is such the respective button is placed in its fully locked position when the case knife is properly seated in the sheath. It is intended that this would place both guards the case knife in a fully locked or guarded condition when stored. Thus the operator must consciously move one or more of the operators to unlock the guard or guards for the next cutting operation after each time she withdraws the inventive case knife from the sheath. This is a safety feature, helping to assure the knife is normally in the fully guarded position.

The following table illustrates the various possibilities or conditions of the blade guards (and sheath where it is provided or used), together with the resulting condition and exemplary uses of the knife when the blade guards are in the conditions specified:

| Sheath | Left Guard | Right Guard | Resulting Blade Condition | Example Use |
|---|---|---|---|---|
| Inserted fully in Sheath | Locked | Locked | Fully guarded | Storage |
| Withdrawn after being fully inserted | Remains locked | Remains locked | Fully guarded | Ready for use but blade is protected |
| Withdrawn after being fully inserted | Left operator moved to first position | Remains locked | Blade exposed when left guard depressed against spring bias | Severing carton lid by resting right guard against lid edge while pressing left guard and blade against upper edge of carton. |
| Withdrawn after being fully inserted | Remains locked | Right operator moved to first position | Blade exposed when right guard depressed against spring bias | Severing carton lid by resting left guard against lid edge while pressing right guard and blade against upper edge of carton. |
| Withdrawn after being fully inserted | Left operator moved to first position | Right operator moved to first position | Blade exposed when either or both guards depressed against spring bias | Cutting center, etc., of corrugated panel to controlled depth |
| Withdrawn after being fully inserted | Left operator moved to second position | Right operator moved to second position | Blade exposed when either or both guards depressed against spring bias | Cutting center, etc., of corrugated panel to full blade depth. |
| Reinserting knife fully into sheath | Left operator in any position | Right operator in any position | Blade becomes fully guarded as operators moved to locked | Storage |

While both preferred embodiments employ a single edge razor blade which can be removed from the holding fixtures in the blade halves and replaced, other blade schemes are contemplated and fall within the inventive concepts taught by these two embodiments. One simple variation would permit the use of a conventional double-edged razor blade. Also, a cutting blade could be insert molded into the handle, eliminating some of the structures needed to permit blade replacing. Such inventive case knives could be so cheaply made as to justify disposing the entire case knife when the blade becomes to dull to function properly. Also, our inventive blade guard could be adapted to operate with the popular "snap-off" blade systems common in the hobby knife and matt knife markets.

Of course, while the preferred embodiment of the invention has been detailed above in order to fully apprise the reader of the invention and how to make and use it, the true scope of applicant's invention is limited only by the appended claims.

The invention claimed is:

1. A knife for cutting a lamina, such as a corrugated panel of a packing case for foodstuffs, comprising a handle for holding a cutting blade, a first guard and a second guard extending from within the handle, the first guard and the second guard flanking the blade when the blade is being held by the handle, the first guard and the second guard being movably mounted from within the handle and independently operable to permit one or both guards to normally prevent contact of the blade with the lamina or to permit contact of the blade with the lamina depending on the position and condition of each of the independently operable guards, and means for operating the guards to permit contact of the blade with the lamina or to prevent contact of the blade with the lamina.

2. A knife for cutting a lamina, such as a corrugated cardboard panel, comprising a handle, a means for holding a cutting blade with a sharp end of the cutting blade protruding outwardly from the handle, a means for guarding the protruding end of the blade, the means for guarding comprising at least a first guard adjacent to the protruding end of the blade, such that said means for guarding can rest on a side surface of the blade means for spring biasing the first guard to normally place a first guard edge of said first guard in a first position extending beyond said protruding end, and means for releasably locking said first guard edge in said first position.

3. A knife as set forth in claim 2 wherein said blade has a flat side, and said first guard is adjacent said flat side.

4. A knife for cutting a lamina, such as a corrugated cardboard panel, comprising a handle, a means for holding a cutting blade with a sharp end of the cutting blade protruding outwardly from the handle, a means for guarding the protruding end of the blade, the means for guarding comprising at least a first guard adjacent to the protruding end of the blade, means for spring biasing the first guard to normally place a first guard edge of said first guard in a first position extending beyond said protruding end, and means for releasably locking said first guard edge in said first position, said blade has a flat side, and said first guard is adjacent said flat side, and wherein said blade has another flat side, and the guarding means includes a second guard adjacent the other flat side of the blade, second means for spring biasing the second guard to normally place the second guard in a first position extending beyond said protruding end, and means for locking said second guard in said first position.

5. A knife for cutting a lamina, such as a corrugated cardboard panel, comprising a handle, a means for holding a cutting blade with a sharp end of the cutting blade protruding outwardly from the handle, a means for guarding the protruding end of the blade, the means for guarding comprising at least a first guard adjacent to the protruding end of the blade, means for spring biasing the first guard to normally place a first guard edge of said first guard in a first position extending beyond said protruding end, and means for releasably locking said first guard edge in said first position, and wherein said first guard includes a guard finger mounted between the first guard and the blade and normally positioned to extend just beyond the protruding end of the blade when the guard is in the first position, the guard finger mounted in a manner to permit the guard finger to resiliently deflect and expose the protruding end of the blade during use.

6. A knife as set forth in claim 4 wherein said second guard includes a supplemental guard mounted between the second guard and the blade and normally positioned to extend just beyond the protruding end of the blade when the second guard is in the first position, the supplemental guard mounted in a manner to permit the supplemental guard to resiliently deflect and expose the protruding end of the blade during use.

7. A knife for cutting a lamina, such as a corrugated cardboard panel, comprising a handle, a means for holding a cutting blade with a sharp end of the cutting blade protruding outwardly from the handle, a means for guarding the protruding end of the blade, the means for guarding comprising at least a first guard adjacent to the protruding end of the blade, means for spring biasing the first guard to normally place a first guard edge of said first guard in a first position extending beyond said protruding end, and means for releasably locking said first guard edge in said first position, wherein the means for guarding include means for permitting the first guard to be deflected against the means for spring biasing to more than one secondary positions, wherein the protruding end of the blade can be exposed to a greater and lesser extent when the means for guiding means is deflected by the means for spring biasing.

8. A knife for cutting a lamina, such as a corrugated cardboard panel, comprising a handle, a means for holding a cutting blade with a sharp end of the cutting blade protruding outwardly from the handle, a means for guarding the protruding end of the blade, the means for guarding comprising at least a first guard adjacent to the protruding end of the blade, means for spring biasing the first guard to normally place a first guard edge of said first guard in a first position extending beyond said protruding end, and means for releasably locking said first guard edge in said first position, wherein said means for guarding further includes a second guard on the opposite side of the protruding end of the blade, a supplemental guard resiliently supported by and carried by the second guard and positioned between the second guard and the protruding end of the blade, the second guard having a means for locking it in the first position extending beyond said protruding blade end, the supplemental guard moving with the second guard when the second guard is in an unlocked condition.

* * * * *